US008342189B2

(12) United States Patent
Gregorek

(10) Patent No.: US 8,342,189 B2
(45) Date of Patent: Jan. 1, 2013

(54) HAIR ROLLER SET

(76) Inventor: Judy Gregorek, Locust Valley, NY (US)

( * ) Notice: Subject to any disclaimer, the term of this patent is extended or adjusted under 35 U.S.C. 154(b) by 232 days.

(21) Appl. No.: 12/752,962

(22) Filed: Apr. 1, 2010

(65) Prior Publication Data

US 2010/0252062 A1 Oct. 7, 2010

Related U.S. Application Data

(60) Provisional application No. 61/166,119, filed on Apr. 2, 2009.

(51) Int. Cl.

| | |
|---|---|
| ***A45D 24/00*** | (2006.01) |
| ***A45D 7/00*** | (2006.01) |
| ***A45D 2/12*** | (2006.01) |
| ***A45D 7/02*** | (2006.01) |
| ***A45D 2/00*** | (2006.01) |

(52) U.S. Cl. ..... 132/200; 132/226; 132/212; 132/265

(58) Field of Classification Search ..... 132/265, 132/200, 203, 207, 210, 212, 222, 223, 226, 132/227, 235, 236, 237, 245–257, 261, 263, 132/268, 273, 286, 294, 312; 206/823, 581, 206/503, 505, 507; 220/507, 23.83; D9/744, D9/745; D28/26, 37, 38

See application file for complete search history.

(56) References Cited

U.S. PATENT DOCUMENTS

| | | | | | |
|---|---|---|---|---|---|
| 2,229,841 | A | * | 1/1941 | Eyraud et al. | 132/122 |
| 3,128,882 | A | * | 4/1964 | Kardulas | 211/13.1 |
| 3,250,895 | A | * | 5/1966 | McNair | 219/222 |
| 3,260,267 | A | | 7/1966 | Rubenstein et al. | |
| 3,326,222 | A | | 6/1967 | Rosenheim | |
| 3,395,790 | A | * | 8/1968 | Smith | 132/261 |
| 3,572,350 | A | * | 3/1971 | Adams et al. | 132/252 |
| 3,590,829 | A | * | 7/1971 | Parisi | 132/248 |
| 3,616,804 | A | * | 11/1971 | Simoneaux | 132/252 |
| 3,618,750 | A | * | 11/1971 | Reiner | 206/743 |
| 3,682,182 | A | * | 8/1972 | Small | 132/252 |
| 3,692,034 | A | * | 9/1972 | Stone | 132/252 |
| 3,713,455 | A | | 1/1973 | Chen et al. | |
| 3,835,871 | A | | 9/1974 | Roccanova | |
| 3,848,610 | A | * | 11/1974 | Thomas | 132/245 |
| 3,970,095 | A | * | 7/1976 | Prince et al. | 132/245 |
| 4,022,226 | A | | 5/1977 | Muenstermann | |
| 4,135,525 | A | | 1/1979 | Kriger | |
| 4,141,370 | A | | 2/1979 | Haas | |
| 4,141,371 | A | | 2/1979 | Gangnath | |
| 4,592,375 | A | * | 6/1986 | Beier | 132/226 |
| 4,911,186 | A | | 3/1990 | Hayden | |

(Continued)

*Primary Examiner* — Vanitha Elgart

(74) *Attorney, Agent, or Firm* — Webb IP Law Group; Jason P. Webb; Danny Y. H. Cheng

(57) ABSTRACT

A hair roller set configured to facilitate securing hair in a curled position during hair curling comprising a plurality of hair rollers positioned in a substantially parallel relation and nested together such that each of the plurality of hair rollers is directly enclosed by no more than one other hair roller and directly encloses no more than one other hair roller, wherein the plurality of hair rollers each include a flexible cylindrical body that is substantially separated lengthwise along one side of the flexible cylindrical body, thereby forming a pair of interior faces, wherein the cylindrical body does not include any articulation devices configured to facilitate widening the flexible cylindrical body. The interior faces include mating devices configured to selectably couple the interior faces together. The hair roller set also includes a flocculent layer coupled about the flexible cylindrical body by adhesive.

8 Claims, 8 Drawing Sheets

U.S. PATENT DOCUMENTS 5,220,931 A * 6/1993 Aida ..... 132/233
5,662,128 A 9/1997 Habibi
5,713,380 A * 2/1998 Dietze ..... 132/262
5,715,846 A * 2/1998 Kim ..... 132/222
5,730,161 A * 3/1998 Kohanek ..... 132/273
5,819,762 A * 10/1998 Kim ..... 132/222
5,887,599 A * 3/1999 Habibi ..... 132/205
5,890,496 A 4/1999 Habibi
5,901,711 A * 5/1999 Jeremy ..... 132/226
5,944,029 A 8/1999 Brenner
5,981,908 A 11/1999 McGuire et al.
6,012,466 A * 1/2000 Apanasewicz ..... 132/222
6,092,534 A 7/2000 Cheung
6,371,131 B1 * 4/2002 Finocchiaro et al. ..... 132/297
6,394,101 B1 * 5/2002 Secreto ..... 132/222
7,070,055 B2 * 7/2006 Lechanoine et al. ..... 206/581
D621,094 S * 8/2010 Kaizuka ..... D28/38
2003/0127347 A1 * 7/2003 Carlucci et al. ..... 206/349
2006/0130866 A1 * 6/2006 Shimomura ..... 132/226
2007/0084479 A1 * 4/2007 Ryan-Jakimas ..... 132/246
2009/0165811 A1 * 7/2009 Zimmerman ..... 132/203
2009/0229624 A1 * 9/2009 Purvis et al. ..... 132/120

* cited by examiner

HAIR ROLLER SET

CROSS-REFERENCE TO RELATED APPLICATIONS

This invention claims priority, under 35 U.S.C. §120, to the U.S. Provisional Patent Application No. 61/166,119 by Judy Gregorek filed on Apr. 2, 2009, which is incorporated by reference herein.

BACKGROUND OF THE INVENTION

1. Field of the Invention

The present invention relates to systems, and devices for treating hair and methods related to the same, specifically to a hair roller set, device, and method of storing/using the same.

2. Description of the Related Art

A very common method of hair treatment includes curling hair using hair rollers. Generally, a practitioner will wrap the hair about a hair roller. Through the application of heat and/or various chemical treatments, the hair will take on a curled configuration. Hair rollers tend to be cylindrical with a hollow core, into which a heating element may be placed. Hair rollers thereby provide a structure that supports curled hair and permits the application of the appropriate treatments so that the hair may be easily curled.

Carrying curlers present an awkward and space-consuming problem. Normally, people may use from about twelve to twenty five hair rollers at a time. Often the hair rollers are of approximately the same shape and size in order to create a consistent "look" for the curls generated thereby. The hair rollers are bulky and tend to take up valuable space.

Some improvements have been made in the field. The following references are presented in their own words and such usage is intended to be subordinate to any terms, meanings, definitions presented herein. The supported teachings of each reference are incorporated by reference herein:

U.S. Pat. No. 4,135,525, issued to Kriger, discloses a plurality of telescopically associated hair rollers each have an open first end, a second end with openings therein and an outer perforate wall for supporting a flow of drying air therethrough. The rollers are telescopically associated in a nested arrangement with adjacent rollers engageable at the second ends so as to prevent relative rotation therebetween and promote mutual rotation. Each roller which encloses another roller has an elongate slot extending from its open end toward the other end for receiving hair therethrough as the roller is axially moved into position about the next inner roller.

U.S. Pat. No. 5,981,908, issued to McGuire et al., discloses a hair roller heating apparatus for heating hair rollers, has a base and a plurality of heating rods of sufficient length to simultaneously hold and heat a plurality of hair rollers. The heating rods further have a distal portion and a proximal portion, the proximal portion attached to the base and the distal portion free for receiving hair rollers. The heating rods also have an outer casing and heating elements placed within the outer casing. An electrical cord provides electricity from an electrical source to the heating elements, Therefore, the heating rods impart sufficient heat to the hair rollers to heat the rollers to a desired temperature. In a preferred embodiment the heating rods are at least 10 inches in length.

U.S. Pat. No. 6,092,534, issued to Cheung, discloses a hair roller assembly formed of a light-weight, concentricaly arranged porous flexible tubular outer sleeve of plastic woven fabric-like material, perforate at least semi-flexible resilient tubular plastic inner support sleeve and a concentrically arranged perforate tubular intermediate sleeve formed of highly heat conductive material and between said outer and inner sleeves, said sleeves being surface to surface engaged with the outer sleeve positively secured to the perforate tubular inner support sleeve and said outer sleeve having spaced bands of outwardly extending flexible filament projections provided with hair-grasping hook-shaped ends.

U.S. Pat. No. 3,835,871, issued to Roccanova, discloses a collapsible cosmetic hair roller consisting of a multiplicity of telescoping sections of generally cylindrical shape which interlock edge to edge upon extension to a preselected desired length and nest section within section upon collapse.

U.S. Pat. No. 5,890,496, issued to Habibi, discloses an adjustable hair curler includes a thin sheet of a flexible resilient material. A coating on a first side of the resilient sheet includes a soft material for contacting and gripping the hair. A coating is also applied to the second opposite side of the resilient sheet. The coatings are able to withstand repeated heat cycling. Application of heat from a heat source to the curler causes heat to flow into the curler, heating the resilient sheet and coatings. The thermal mass of these elements keeps the curler heated for some period of time after the curler is removed from the heat source. By rolling the sheet to form a cylinder so that a portion of the sheet overlaps another portion of the sheet, and clipping the two portions together with a clip such as a bobby pin or the like, the cylinder's shape may be established and held with relative ease and simple adjustability of cylinder diameter. For storage, the sheets may be completely flattened for storage or transport in a very minimal volume.

The inventions heretofore known suffer from a number of disadvantages which include being bulky, difficult to store, difficult to transport, limited in application, limited in use, difficult to use, expensive, inadequate, ineffective, inefficient, difficult and/or expensive to manufacture, and/or cumbersome to use.

What is needed is a hair roller set, device and/or method of storing/using the same that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available hair roller sets, devices, and/or methods of storing/using the same. Accordingly, the present invention has been developed to provide a hair roller set, device and/or method of storing/using the same configured to facilitate securing hair in a curled position during hair curling.

In one embodiment of the invention, there is a hair roller set configured to facilitate securing hair in a curled position during hair curling. The set includes a plurality of hair rollers that may be positioned in a substantially parallel relation such that the hair rollers are not caught against one other and/or may be nested together such that one, more, or each of the plurality of hair rollers is directly enclosed by no more than one other hair roller and/or directly encloses no more than one other hair roller. The plurality of hair rollers may each include a flexible cylindrical body that may be substantially separated lengthwise along one or more sides of the flexible cylindrical body such that the hair rollers may open and form a cavity therein with the opening of sufficient size to permit a user to dispose a hair roller therethrough, thereby forming a pair of interior faces. It may be that the cylindrical body does not include any articulation devices configured to facilitate widening the flexible cylindrical body.

The interior faces may include mating devices that may be configured to selectably couple the interior faces together. It may be that the interior faces may not include any devices configured to selectably couple the interior faces together. Furthermore, the interior faces may include mating guides that may be shaped to direct the interior faces together when compression force is applied to the flexible cylindrical body and/or it may be that the mating guides do not substantially restrict widening of the flexible cylindrical body. Moreover, the interior faces may also include mating devices and/or mating guides. The flexible cylindrical body may be a single molded plastic device. The hair roller set may further include a flocculent layer that may be coupled about the flexible cylindrical body, such as by adhesive.

In another embodiment of the invention, there is a hair roller configured to facilitate securing hair in a curled position during hair curling. The hair roller may include a flexible columnar body that may be substantially separated lengthwise along one or more sides of the flexible columnar body. Such may form a pair of interior faces. Interior faces may include mating guides. It may be that mating guides do not substantially restrict widening of the flexible columnar body. It may be that the columnar body does not include any articulation devices that may be configured to facilitate widening the flexible columnar body. The mating guides may be shaped to direct the interior faces together when compression force is applied to the flexible columnar body. The interior faces may include mating devices that may be configured to selectably couple the interior faces together. In addition, it may be that the interior faces do not include any devices configured to selectably couple the interior faces together. The flexible columnar body may be a single molded plastic device. The hair roller may include a flocculent layer coupled about the flexible cylindrical body by adhesive. The flexible columnar body may be cylindrical, spherical, cone-shaped, and/or etc. Furthermore, the flexible columnar body may consist of a single molded plastic device.

In yet another embodiment of the invention, there is a method of storing hair curling devices, comprising one or more of the steps of: widening a first flexible cylindrical body of a hair curler by applying force against a pair of interior faces formed along a lengthwise separation of the hair curler, disposing a second hair curler within an interior of the first flexible cylindrical body, thereby nesting the second hair curler within the first hair curler, widening the first and second cylindrical bodies of the first and second hair curlers respectively by applying force against the respective interior faces, and/or disposing a third hair roller within an interior of the second hair roller, thereby nesting the third hair roller within the first hair roller and directly within the second hair roller.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
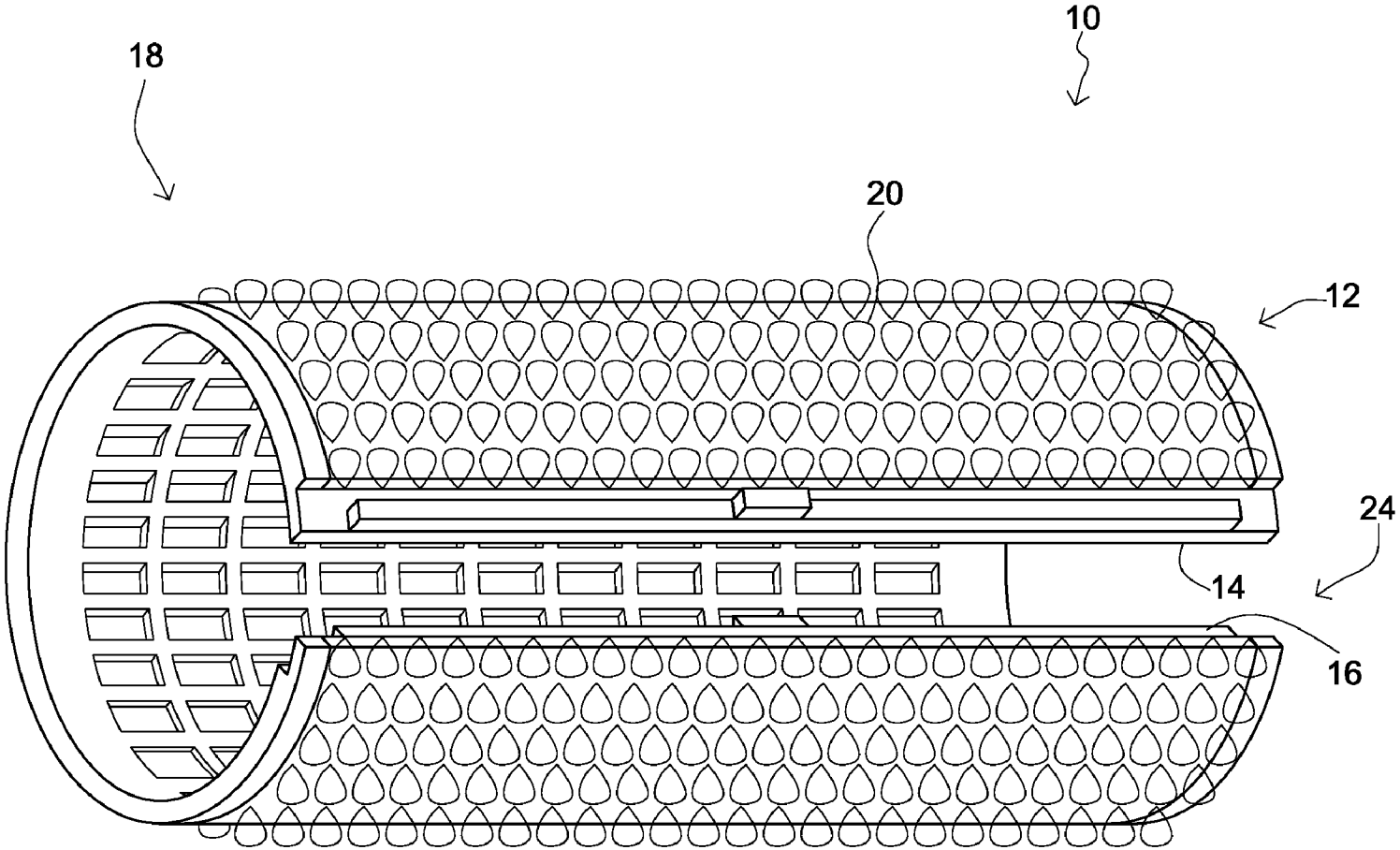
FIG. 1 is a side perspective view of a hair roller, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a side perspective view of a hair roller, according to one embodiment of the invention. There is shown a hair roller configured to facilitate securing hair in a curled position during hair curling. The hair roller 10 includes a flexible cylindrical/columnar body 12 that is substantially separated lengthwise along one side of the flexible cylindrical body, thereby forming a pair of interior faces 14, 16. As used in this application, cylindrical is intended to mean "like a cylinder" and columnar is intended to mean "having a high aspect ratio." The illustrated flexible cylindrical body 12 is both cylindrical and columnar. In the case of a cone shaped body, such may be columnar but not cylindrical. The illustrated cylindrical body 12 does not include any articulation devices configured to facilitate widening the flexible cylindrical body 12. For example, the illustrated cylindrical body includes no pivots or hinges.

As illustrated in FIG. 1, the hair roller 10 is flexed in an open mode 24 such that the interior faces are spaced apart and the cylinder is not overlapping itself. The illustrated flexible cylindrical body 12 is a single molded plastic device 18 including a split hollow plastic cylinder having an aperture grid therethrough. The hair roller 10 also includes a flocculent layer 20 coupled about the flexible cylindrical body 12 by adhesive. A non-limiting example of a flocculent layer may be, but is not limited to, looped fibers, woven or tangled fibers, outwardly facing fibers, foam, etc.

The illustrated interior faces 14, 16 include both mating guides and mating devices such that as the interior faces are pushed together, they are guided to meet and may be selectably locked in place. In operation of the illustrated embodiment, a user couples the interior faces 14, 16 together to make a complete cylinder and secures the hair roller 10 to the hair of the user. The flocculent layer 20 of the hair roller 10 advantageously engages the hair for convenience and effectiveness. The user may use a plurality of hair rollers to create a desired effect during hair curling. When finished, the user may decouple the mating devices of each roller and then nest the rollers together, each into the split cavity of another. Accordingly, a large number of rollers may be stored in a space only slightly larger than that occupied by a single roller.

Figure 2:
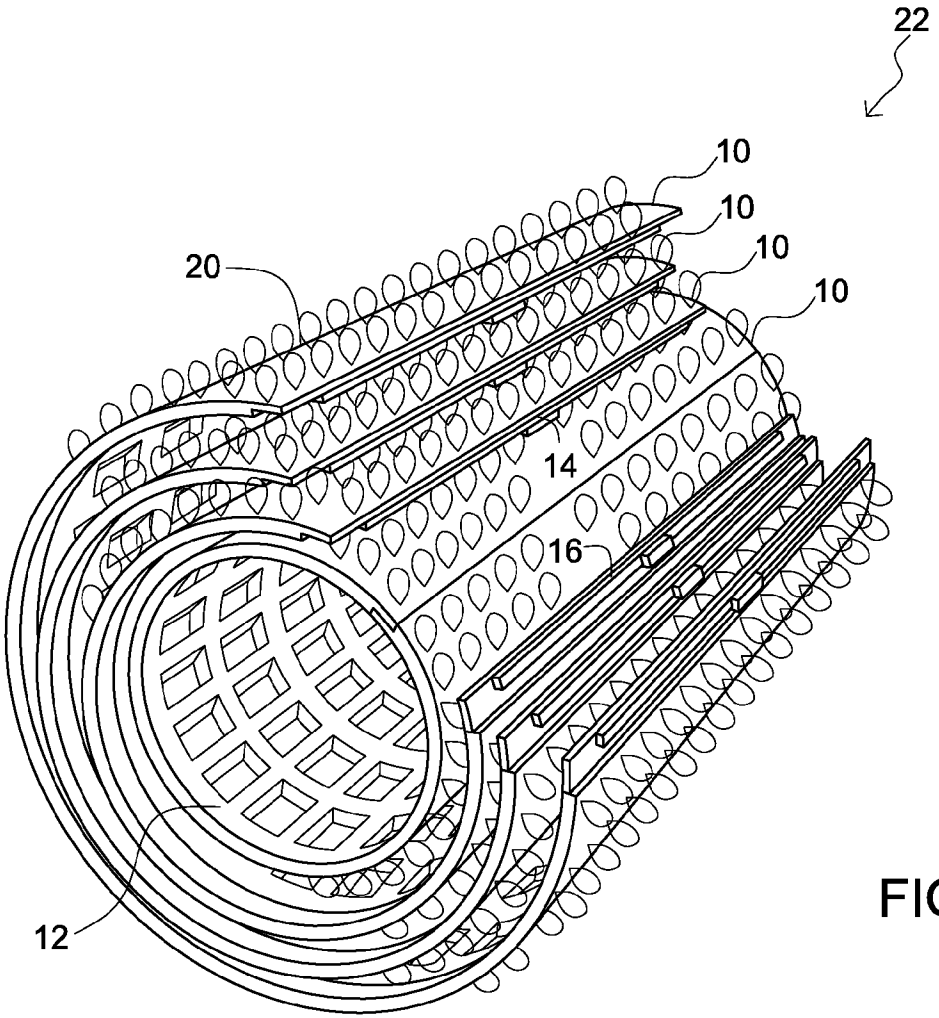
FIG. 2 is a perspective view of a hair roller set, according to one embodiment of the invention.

FIG. 2 is a perspective view of a hair roller set, according to one embodiment of the invention, there is a hair roller set 22 configured to facilitate securing hair in a curled position during hair curling. The hair roller set 22 includes a plurality of hair rollers 10 positioned in a substantially parallel relation and nested together such that each of the plurality of hair rollers 10 is directly enclosed by no more than one other hair roller and directly encloses no more than one other hair roller. Accordingly, space utilization is maximized throughout the nested set.

The illustrated plurality of hair rollers 10 each include a flexible cylindrical body 12 that is substantially separated/split/divided lengthwise along one side of the flexible cylindrical body 12, thereby forming a pair of interior faces 14, 16. Accordingly, the flexible cylindrical bodies of the hair rollers form split cavities into which other rollers of substantially identical sizes may be disposed. Hair rollers so disposed may be of substantially differing sizes and the flexibility of each will permit a variety of possible nesting solutions, including but not limited to, solutions wherein smaller rollers may contain larger rollers. Advantageously, a user having a set of differently sized rollers may be enabled to nest the entire set without having to sort or organize the set by size.

In operation of one embodiment of the invention, a user removes one of the hair rollers 10 from the hair roller set 22, and continues to remove hair rollers 10 from the set 22 until each hair roller 10 is completely separated from each other. The user may couple the interior faces 14, 16 of each hair roller 10 together wherein the interior faces include mating guides and/or devices. The user secures each hair roller 10 to the hair of the user. The flocculent layer 20 of each hair roller 10 gently couples to the hair, as the hair roller 10 is spun around the hair, thereby securing hair in a curled position during hair curling. The user disposes a plurality of hair rollers to create a desired effect during hair curling.

Figure 3:
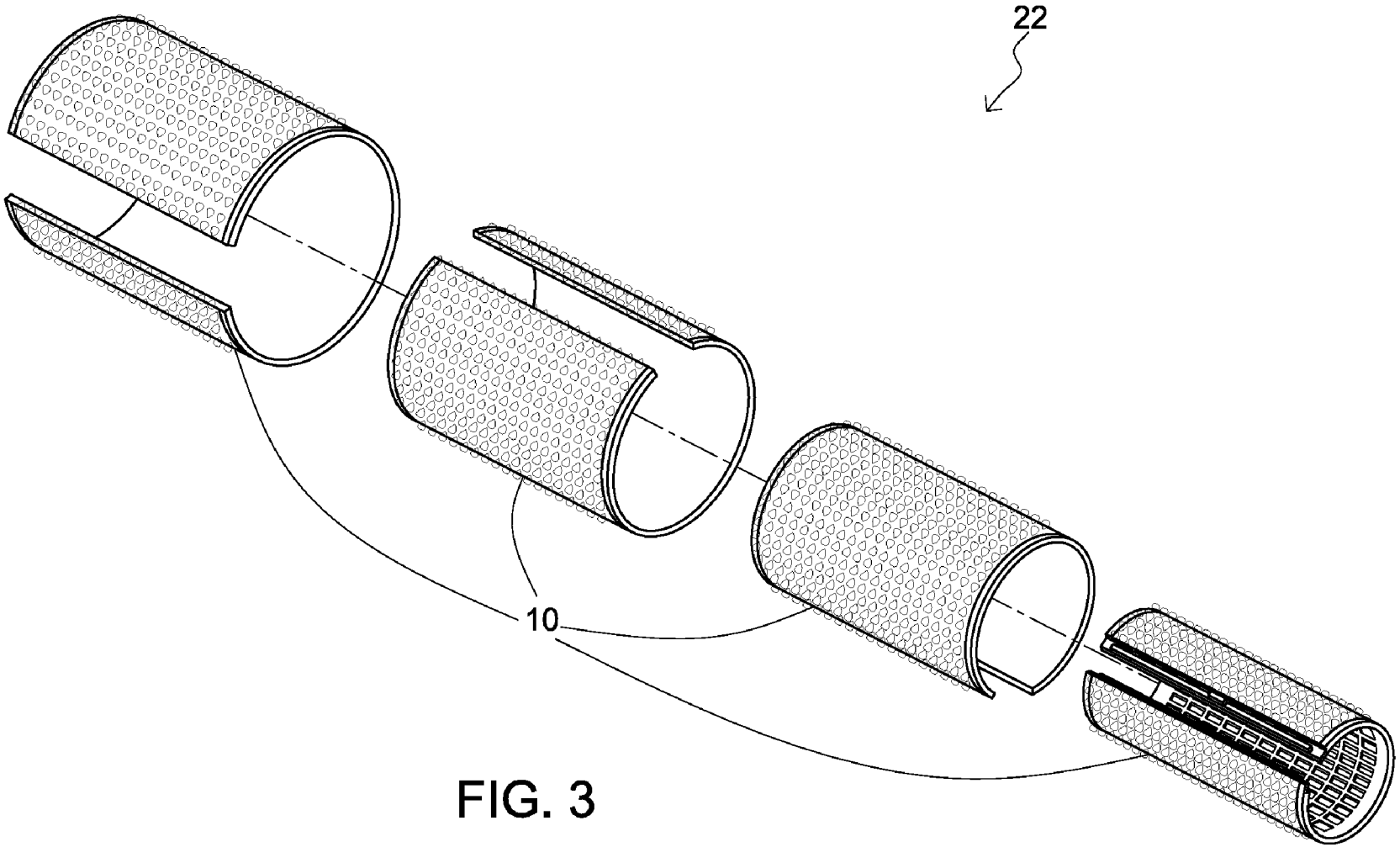
FIG. 3 is an exploded view of a hair roller set, according to one embodiment of the invention.

FIG. 3 is an exploded view of a hair roller set 22, according to one embodiment of the invention. The illustrated hair roller set 22 includes a plurality of hair rollers 10 positioned in a substantially parallel relation. The plurality of hair rollers 10 nest together such that each of the plurality of hair rollers 10 is directly enclosed by no more than one other hair roller and directly encloses no more than one other hair roller. The outer hair rollers of the nest are in an open mode to enable enclosure of another hair roller therein. The illustrated plurality of hair rollers 10 are of successively smaller size. Advantageously, the split in each permits loading the hair rollers into each other through the split instead of through the top or bottom of each. This may be particularly useful when the differently sized rollers are only slightly differently sized, especially in comparison to the thicknesses of their respective flocculent layers. It may also be useful when flocculent layers have a particularly high co-efficient of friction.

Figure 4:
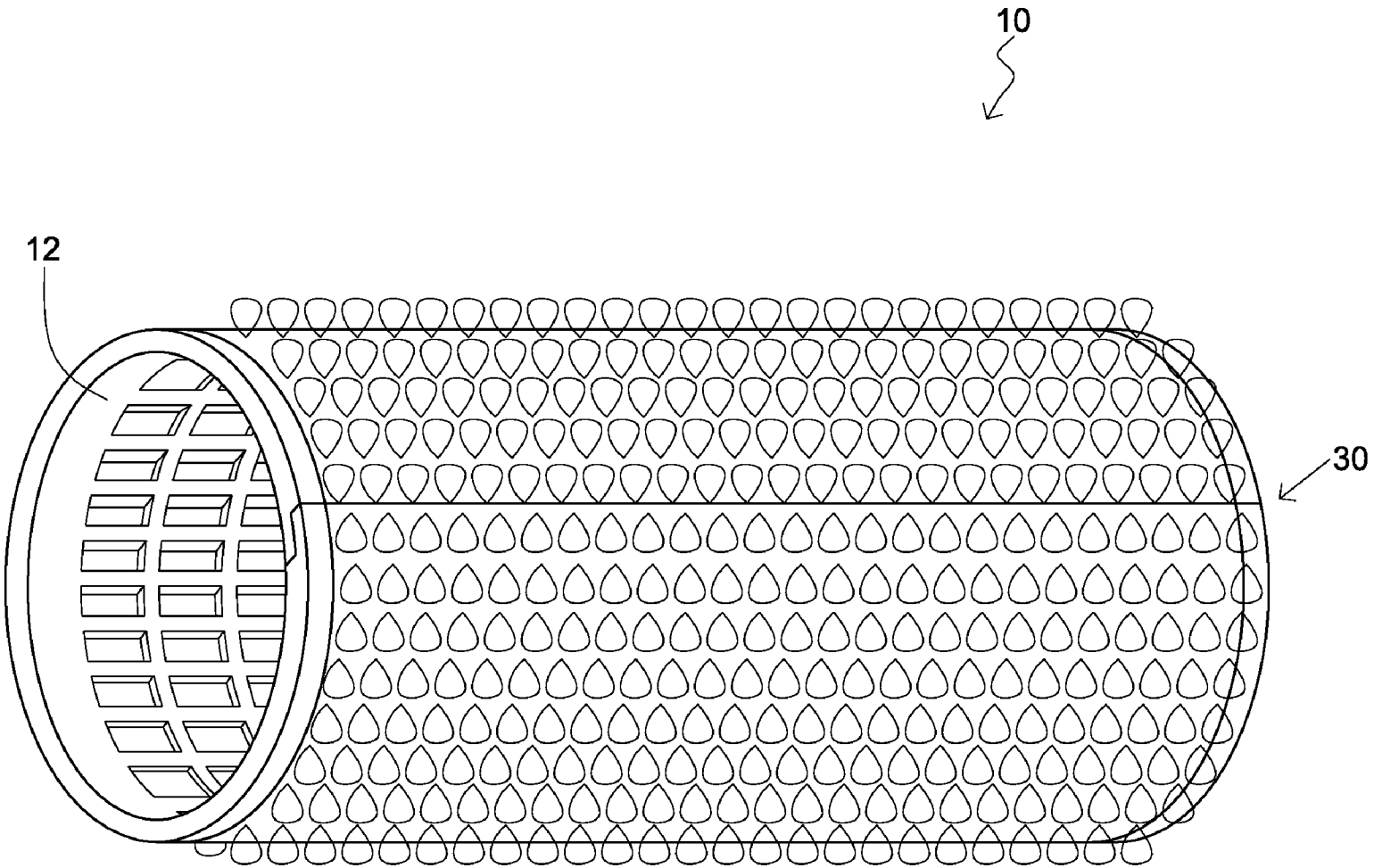
FIG. 4 is a side perspective view of a hair roller, according to one embodiment of the invention.

FIG. 4 is a side perspective view of a hair roller 10 similar to that shown in FIG. 1, according to one embodiment of the invention. The illustrated hair roller 10 is in a closed mode 30. The closed hair roller 10 includes a flexible cylindrical body 12 that is substantially separated lengthwise along one side of the flexible cylindrical body 12, thereby forming a pair of interior faces that are matched and mated together by at least mating guides (the matching L-shaped portions of the interior faces). As the interior faces are mated, the hair roller 10 is secured in a cylindrical manner such that forces transverse to the mating are opposed. The cylindrical body does not include any articulation devices configured to facilitate widening the flexible cylindrical body.

Figure 5:
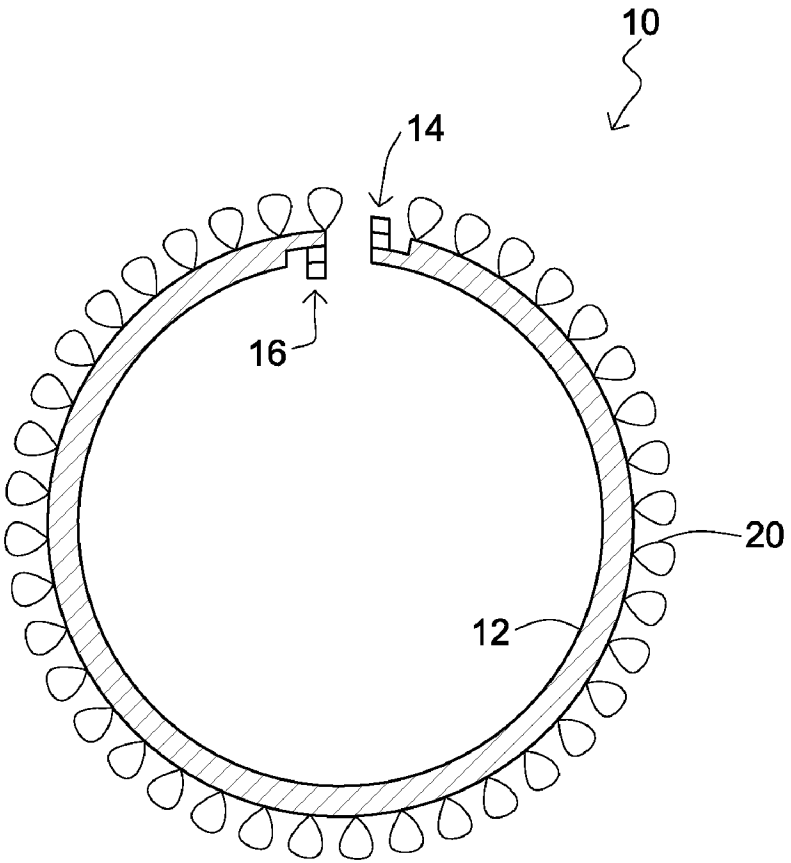
FIG. 5 is a cross-sectional view of a hair roller, according to one embodiment of the invention.

FIG. 5 is a cross-sectional view of a hair roller 10, according to one embodiment of the invention. The hair roller 10 includes a flexible cylindrical body 12 that is substantially separated lengthwise along one side of the flexible cylindrical body, thereby forming a pair of interior faces 14, 16. The interior faces include mating devices configured to selectably couple the interior faces together when the mating devices are coupled. The illustrated mating devices include oppositely shaped hook-like structures configured to "entangle" when overlapping. Accordingly, by the appropriate applications of force, a user may couple and/or decouple the mating devices. The hair roller 10 also includes a flocculent layer 20 coupled about the flexible cylindrical body 12 by adhesive.

Figure 6:
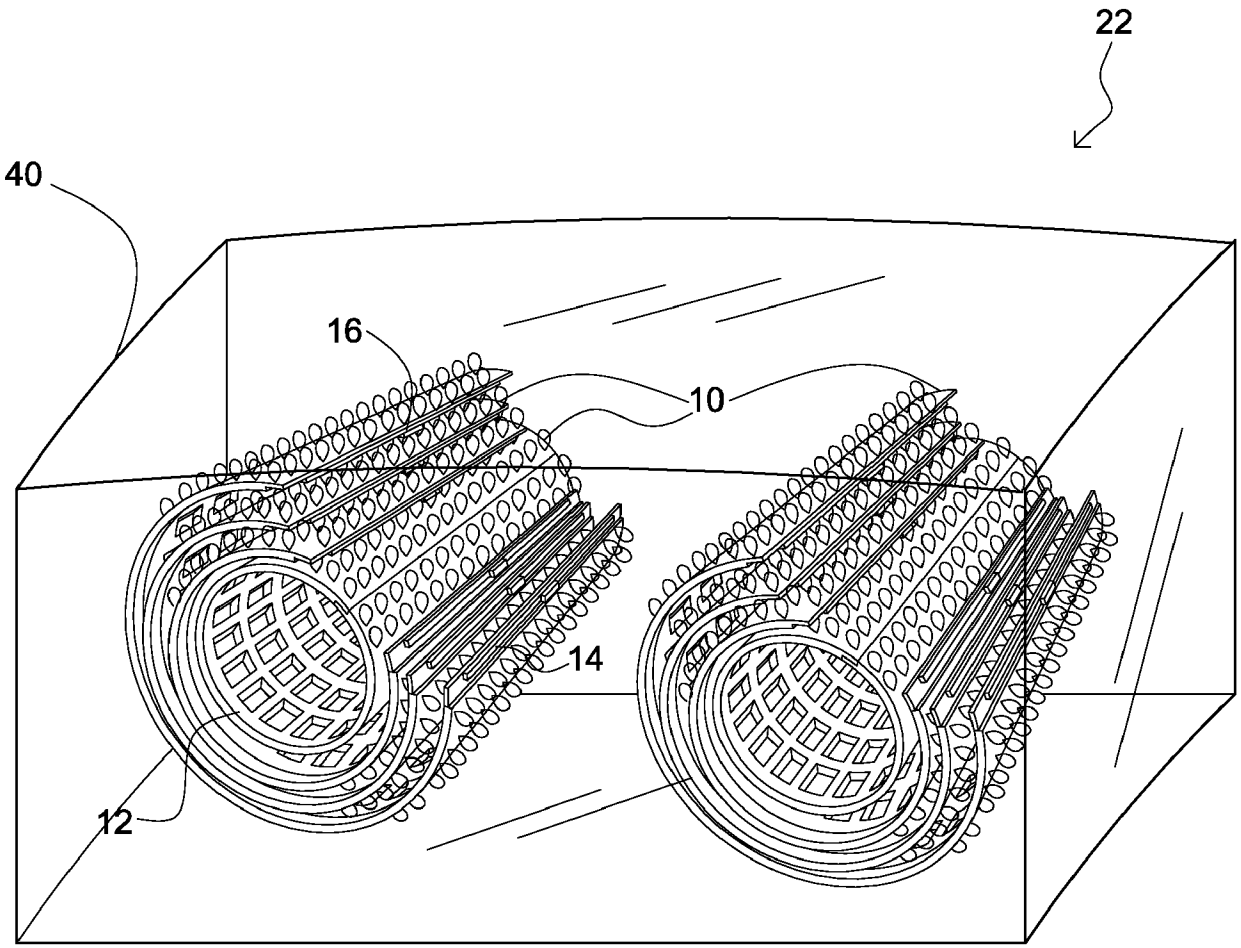
FIG. 6 is a perspective view of a hair roller set disposed in a product packaging, according to one embodiment of the invention.

FIG. 6 is a perspective view of a hair roller set 22 disposed in a product packaging 40, according to one embodiment of the invention. There is a hair roller set 22 configured to facilitate securing hair in a curled position during hair curling, comprising a plurality of hair rollers 10 positioned in a substantially parallel relation and nested together such that each of the plurality of hair rollers 10 is directly, or adjacently, enclosed by no more than one other hair roller and directly, or adjacently, encloses no more than one other hair roller. The plurality of hair rollers 10 may each include a flexible cylindrical body 12 that is substantially separated lengthwise along one side of the flexible cylindrical body 12, thereby forming a pair of interior faces 14, 16, wherein the cylindrical body 12 does not include any articulation devices configured to facilitate widening the flexible cylindrical body 12.

Figure 7:
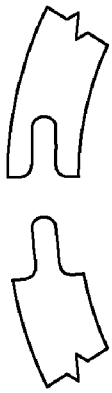

FIG. 7 illustrates a partial cross-sectional view of a pair of mating guides. The illustrated mating guides include a tongue matching a groove/fork configuration, such that as the interior faces are brought together small variances in positioning are automatically adjusted to a more perfect matching.

Figure 8:
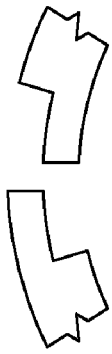

FIG. 8 illustrates a partial cross-sectional view of a pair of mating guides. The illustrated mating guides of FIG. 8 are L-shaped. The L-shaped guides generally only guide against matching variances in a single direction.

Figure 9:
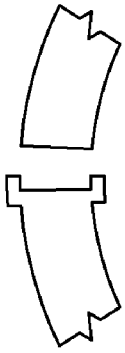
FIGS. 7-11 are partial cross-sectional view of interior faces according to one embodiment of the invention.

FIG. 9 illustrates a partial cross-sectional view of a pair of mating guides. The illustrated mating guides are similar to those of FIG. 7, except that one of the mating guides is merely the standard interior face and the other mating guide is configured to entrap the standard face and prevent variances in matching when connected.

Figure 10:
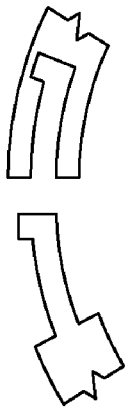

FIG. 10 illustrates a partial cross-sectional view of a pair of mating guides and a pair of mating devices. In particular, the mating guides are similar to those of FIG. 7. The mating devices include transverse tongue and groove structures configured to snap into place and hold the interior faces in place when attached.

Figure 11:
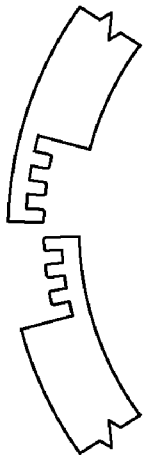

FIG. 11 illustrates a partial cross-sectional view of a pair of mating guides and mating devices. The illustrated mating guides are similar to those of FIG. 8. The illustrated mating devices are tooth-like structures configured to entangle when together.

Figure 12:
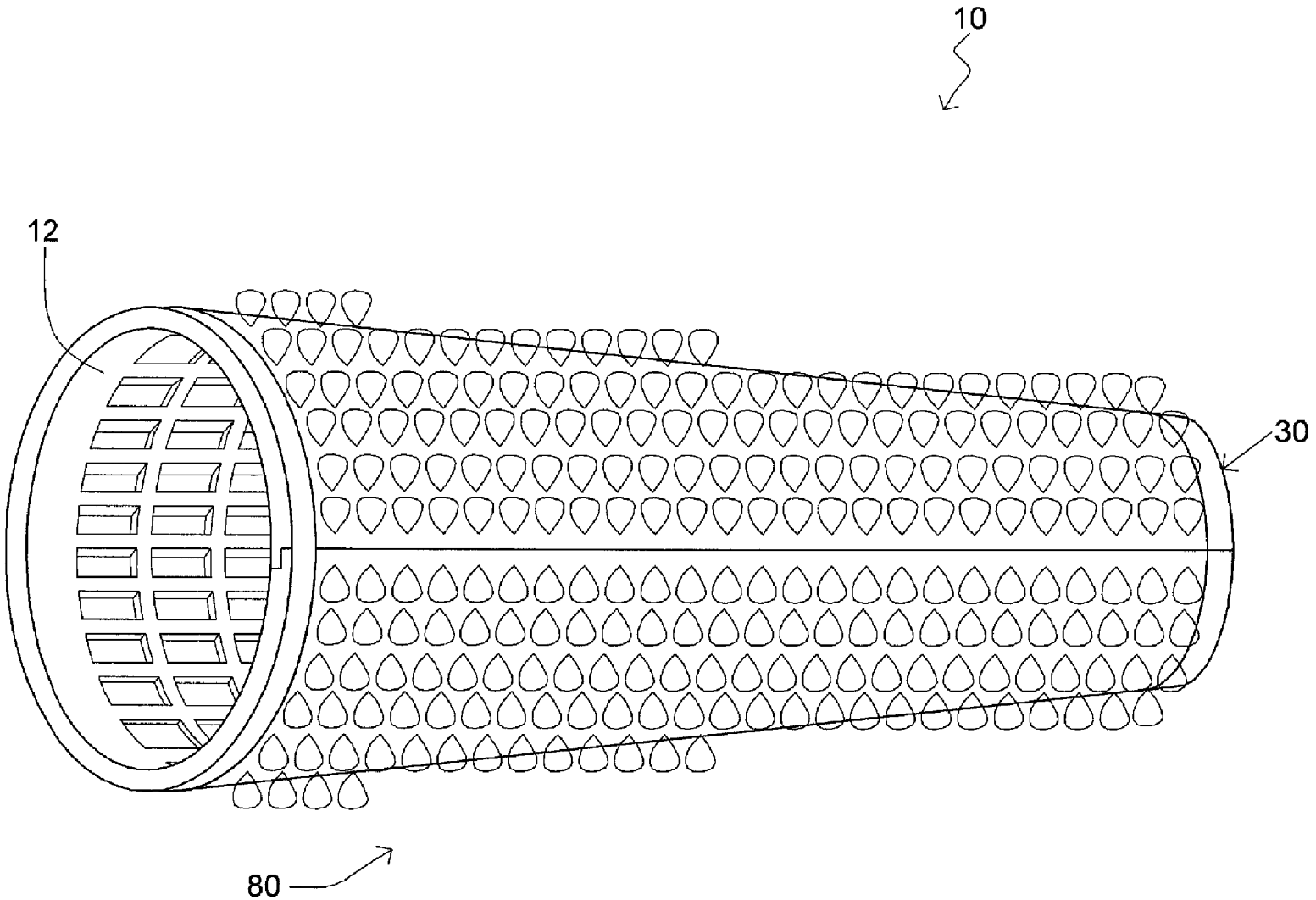
FIG. 12 is a perspective view of a cone-shaped columnar body, according to one embodiment of the invention.

FIG. 12 illustrates a perspective view of a cone-shaped columnar body, according to one embodiment of the invention.

Examples of mating devices without mating guides includes but is not limited to flat interior faces having snaps, hook-and-loop, peg-and-hole and the like.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, the illustrated flocculent layers show substantially consistent grids of loops. It is understood that embodiments of the invention may include a great variety of configurations of flocculent layers, including wherein the flocculent layer does not cover substantially all of the outer portions of a body.

Additionally, although the figures illustrate cylindrical flexible bodies, it is understood that an embodiment may include flexible bodies of different shapes, including but not limited to bodies that are cone-like, spherical, rectangular, and etc.

It is also envisioned that portions or entire components may include and/or consist of materials other than plastics so long as they are suitable for the intended purpose, including but not limited to metals, wood, ceramics, composites and the like.

It is expected that there could be numerous variations of the design of this invention. An example is that the hair rollers within a set may be of differing sizes, shapes, colors, materials, and etc.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A hair roller set configured to facilitate securing hair in a curled position during hair curling, comprising:

a plurality of hair rollers positioned in a substantially parallel relation and nested together such that each of the plurality of hair rollers is directly enclosed by no more than one other hair roller and directly encloses no more than one other hair roller, wherein the plurality of hair rollers each include: a flexible cylindrical body that is completely separated lengthwise along one side of the flexible cylindrical body, thereby forming a pair of interior faces, wherein the cylindrical body does not include any articulation devices configured to facilitate widening the flexible cylindrical body; wherein the interior faces include mating devices configured to selectably couple the interior faces together; wherein the mating devices extend towards each other from tips of the interior faces and are configured to restrict radial motion of the tips relative to each other when the mating devices are engaged.

2. The hair roller set of claim 1, wherein the flexible cylindrical body is a single molded plastic device.

3. The hair roller set of claim 1, further comprising a flocculent layer coupled about the flexible cylindrical body by adhesive.

4. The hair roller set of claim 1, wherein the interior faces include mating guides shaped to direct the interior faces together when compression force is applied to the flexible cylindrical body but do not substantially restrict widening of the flexible cylindrical body.

5. A method of storing hair curling devices, comprising the steps of:

a) separating a pair of mating guides of a pair of interior faces of a hair curler and widening a first flexible cylindrical body of the hair curler by applying force against the pair of interior faces formed along a lengthwise separation of the hair curler;

b) disposing a second hair curler within an interior of the first flexible cylindrical body, thereby nesting the second hair curler within the first hair curler;

c) separating a pair of mating guides of the second hair curler and widening the first and second cylindrical bodies of the first and second hair curlers respectively by applying force against the respective interior faces; and d) disposing a third hair curler within an interior of the second hair curler, thereby nesting the third hair curler within the first hair curler and directly within the second hair curler.

6. The method of claim 5, wherein the third curler is in a closed mode, before being disposed within the interior of the second hair curler.

7. The method of claim 5, further comprising the step of widening a fourth cylindrical body of a fourth hair curler and enclosing the third hair curler therein.

8. The method of claim 5, further comprising utilizing the hair curlers to curl hair.

* * * * *